United States Patent [19]

Younge

[11] 4,347,130

[45] Aug. 31, 1982

[54] PLACER MINERAL CONCENTRATOR AND PROCESS

[76] Inventor: Earl G. Younge, 20369 - 49A Ave., Langley, B.C., V3A 7H3, Canada

[21] Appl. No.: 247,322

[22] Filed: Mar. 25, 1981

Related U.S. Application Data

[63] Continuation-in-part of Ser. No. 50,310, Jun. 20, 1979, Pat. No. 4,265,743.

[30] Foreign Application Priority Data

Nov. 23, 1978 [CA] Canada ..... 316785

[51] Int. Cl.[3] ..... B03B 5/56

[52] U.S. Cl. ..... 209/452

[58] Field of Search ..... 209/155, 435, 444, 445, 209/451, 452, 44; 233/1 D, 14 A, 14 R

[56] References Cited

U.S. PATENT DOCUMENTS 2,053,802 9/1936 Nicol ..... 209/452

4,265,743 5/1981 Younge ..... 209/452

*Primary Examiner*—Ralph J. Hill

*Attorney, Agent, or Firm*—Jenkins, Coffey, Hyland, Badger & Conard

[57] ABSTRACT

The present invention provides for a device and process for extracting heavy particles from lighter particles. The inventive device uses a unique riffle action, causing separation of heavy mineral from waste material, in combination with centrifugal force to retain the separated minerals in the concentrator. The concentrator processes a wide range of particle size feed for the extraction of heavy minerals. The device and process of the invention can extract a great percentage of very fine particles, as well as coarser particles. The machinery of the process can be installed in a roadworthy trailer for delivery and use at the excavation site.

7 Claims, 15 Drawing Figures

#1 200 MESH, 1 OUNCE
#2 +200-10 MESH, 1 OUNCE
#3 +10 MESH-3/8", 1 OUNCE
B/S BLACK SAND

#1 200 MESH, 1 OUNCE
#2 +200-10 MESH, 1 OUNCE
#3 +10 MESH-3/8", 1 OUNCE
B/S BLACK SAND

#1 200 MESH, 1 OUNCE
#2 +200-10 MESH, 1 OUNCE
#3 +10 MESH-3/8", 1 OUNCE
B/S BLACK SAND

#1 200 MESH, 1 OUNCE
#2 +200-10 MESH, 1 OUNCE
#3 +10 MESH-3/8", 1 OUNCE
B/S BLACK SAND

#1 200 MESH, 1 OUNCE
#2 +200-10 MESH, 1 OUNCE
#3 +10 MESH-$\frac{3}{8}$", 1 OUNCE
B/S BLACK SAND

#1 200 MESH, 1 OUNCE
#2 +200-10 MESH, 1 OUNCE
#3 +10 MESH-$\frac{3}{8}$", 1 OUNCE
B/S BLACK SAND

#1 200 MESH, 1 OUNCE
#2 +200 – 10 MESH, 1 OUNCE
#3 +10 MESH – $\frac{3}{8}$", 1 OUNCE
B/S BLACK SAND

#1 200 MESH, 1 OUNCE
#2 +200 – 10 MESH, 1 OUNCE
#3 +10 MESH – $\frac{3}{8}$", 1 OUNCE
B/S BLACK SAND

PLACER MINERAL CONCENTRATOR AND PROCESS

This application is a continuation-in-part of co-pending application Ser. No. 50,310 filed June 20, 1979, now U.S. Pat. No. 4,265,743.

The invention of this application relates to the art of extracting valuable minerals from placer deposits or other suitable material. The extraction of gold, silver and platinum from wet gravels and dry materials dates back to pre-Roman times. Gravity separation devices were usually used to extract placer gold in the past and they are used essentially unchanged to this day. These machines are expensive and they are usually not portable, which requires that the operator move material to the machines for processing. Gravity separating devices use vast quantities of water and their effluent causes silting of streams.

The present invention uses much less water and can accept a very wide particle size range as feed. The device of the invention can recover very small particles of gold, in significant quantities.

DESCRIPTION OF THE PRIOR ART

Placers may be regarded as potentially commercial deposits of natural detrital material which have valuable mineral particles in the form of discrete grains.

Placer minerals are generally extracted through the use of gravity. The desired mineral to be extracted has a higher specific gravity than the material with which it is mixed and this property is utilized in its separation.

Some examples of the machines that are used in extracting placer minerals are jigs, pinched sluices, spirals, cone concentrators, shaking tables, and sluice boxes. Most of these machines are stationary installations, only the sluice box and the device of the invention are portable. These stationary gravity separation devices require solid, rigid, motion-proof installation. Control of vibration and motion increases their efficiency. Once installed, it is a major and costly undertaking to move these installations to another location. Consequently, the user must transport material to the stationary plant for processing. The processed tailings must be removed from the plant to a dump site. The cost of transporting to and from the fixed processing plant can quickly become prohibitive. Placer ore reserves are usually small per area of surface. Placer mining thus requires coverage of wide areas further lengthening the distance between the excavation site and the fixed processing plant. Haulage costs rise accordingly.

This haulage cost problem forced placer mines to use the notoriously inefficient but portable sluice box. Both the traditional sluice box and the device of the invention can be moved up and operated at the site of excavation. The invention can be repeatedly moved up to the site of the excavation as the area of excavation expands. The invention in one embodiment is housed in a compact, road-worthy trailer or trailers. The trailer can even be moved into excavation pits caused when overburden is stripped off to reveal placer deposits. This placement of the trailer saves the operators from raising the placer material to ground level. The device of the invention is vibration tolerant and this allows it to be housed and used in a trailer. The trailer can be pulled along highways and back roads to the excavation site.

Placer mining devices are notorious for their heavy use of water. The water consumption of gravity-type placer separators is profligate and this precludes their use in many placer deposit areas. Sluice boxes use more water per weight of material processed than the other traditional devices. In comparison, the invention uses very little water. Spiral concentrators and also jigs each consume 1,000–3,000 gallons per ton of material processed. Shaking tables and also pinched sluices each use 2,000–4,000 gallons of water per ton of material processed. Portable sluice boxes use 5,000 to 10,000 gallons of water per ton processed. In comparison, the device of the invention uses only 75 to 125 gallons of water per ton of material processed. The saving in water is very important. A device that is efficient in its consumption of water can be used in many areas where water is not abundant. The device and process of the invention can even be adapted to use water in a closed circuit, re-using most of the original water for many separation cycles. It is possible that the device and process of the invention could be used on mineral bearing placer deposits in arid areas, where water would be carried to the workings and be re-used repeatedly.

The device of the invention can handle a very wide size range of feed particles. Particles from 1 to 12,000 microns (or 12.0 mm) can be used as feed. The device of the invention processes 16 to 25 tons per hour. In contrast, jigs use a feed size of only 25 to 75 microns and process 0.5 to 1.5 tons per hour. Pinched sluices use a feed size range of about 3 to 30 microns at a process rate of 0.5 to 2.5 tons per hour. Spiral concentrators use 3 to 75 micron sized particle feed and process 0.5 to 1 ton per hour. Shaking tables use a 3 to 15 micron size range of feed particles and they process at a rate of 0.5 to 1.5 tons per hour.

The device of the invention can process a wide range of particle sizes at a very significant rate of work, in contrast to the other methods of separation.

The simple sluice box is portable and it processes a high tonnage of material per hour in contrast to the other devices but it suffers from a serious shortcoming. Sluice boxes do not efficiently extract placer particles of less than 2,000 microns which is 2 mm. The smaller the mineral particles are, the lower the percentage rate of recovery. Sluice box operations usually lose 55% to 60% of fine gold to the tailings and they often lose up to 70% to 85%. Fine gold under $\frac{1}{8}$ inch is only incidentally recovered. Sluice box operators generally process that portion of the gravel which has large mineral particles.

The low yield gravels are stripped off and not put through the sluice box, because recovery of mineral fines is so poor and usually uneconomical. The practice is also done in order to save water for sluicing. This wasteful "pay-streak" placer mining can be used because large mineral particles tend to be naturally concentrated in narrow deposits in the gravel beds. Fine mineral particles tend to be evenly dispersed throughout the placer material and these mineral fines usually comprise the bulk of the total mineral content of the placer gravel. Pay-streak high grade mining is thus wasteful and tends to leave much of the placer mineral behind.

It can be generally stated that the recovery of placer minerals under $\frac{1}{8}$ inch size is poor, using traditional machinery, including the traditional sluice box.

The device and process of the invention extracts mineral particles under $\frac{1}{8}$ inch and can yield a good percentage of recovery.

Placer gold as small as 2.5 microns has been recovered with the use of the invention.

In one trial run, a measured 95% of the total gold fines were recovered by use of the invention.

The device of the invention can be cleaned of mineral bearing concentrates in a matter of minutes. Sluices take hours or days to be cleaned out, depending on the size of the sluice box.

The device of the invention uses little water, takes a wide size range of feed and has a high throughput of material with a good percentage of recovery of placer material. The invention recovers much of the mineral fines in placer deposits.

SUMMARY OF THE INVENTION

The present invention provides for a process for concentrating and extracting minerals from feed material such as mineral placers. The device of the invention separates minerals from feed material in a rotating concentrator that is equipped with an assemblage of longitudinal and annular riffles. The annular riffles rise higher in the concentrator than the longitudinal riffles. The rotating concentrator can process pre-screened or unscreened raw material.

BRIEF DESCRIPTION OF THE DRAWINGS

A better understanding of the invention may be had by recourse to the drawings which illustrate one embodiment of the invention, and in which.

DESCRIPTION OF THE DEVICE

The preferred embodiments of the present invention will now be described with reference to the accompanying drawings.

Figure 2:
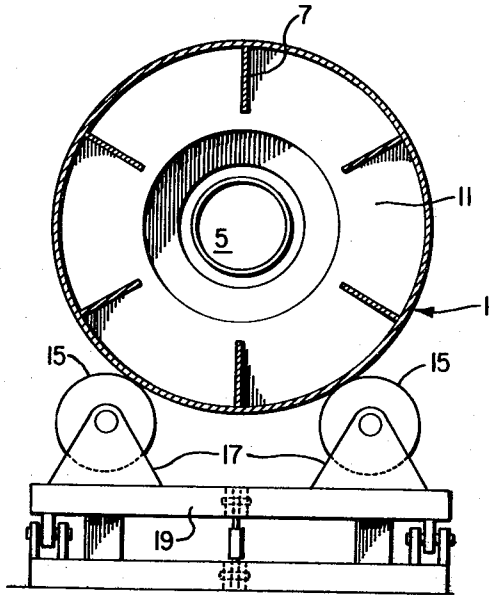
FIG. 2 is an end view, partly in section, along the axis of rotation of the rotating concentrator.
Figure 1:
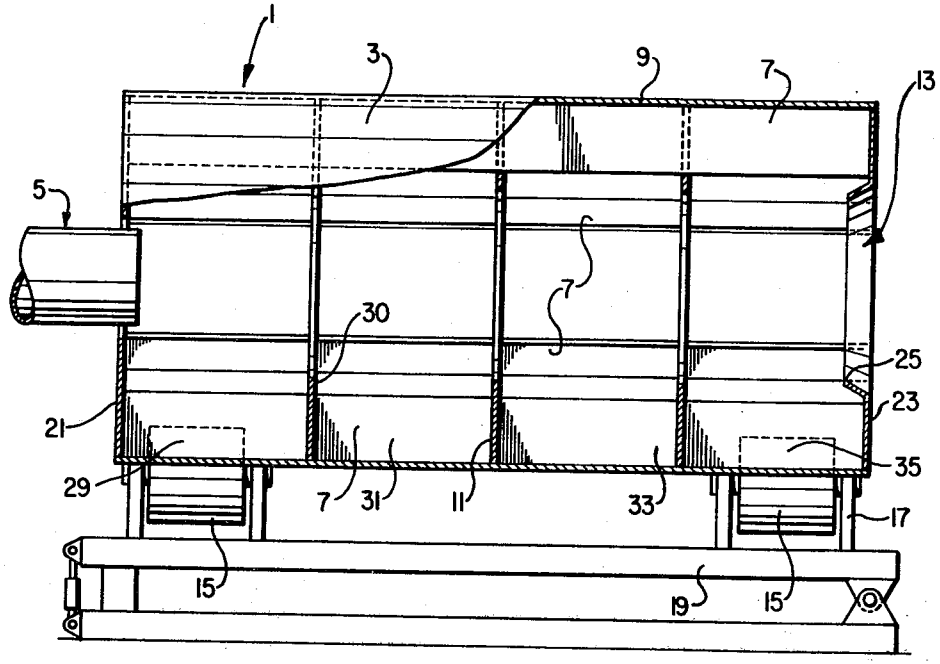
FIG. 1 is a side view, in section, of the rotating concentrator.
Figure 3:
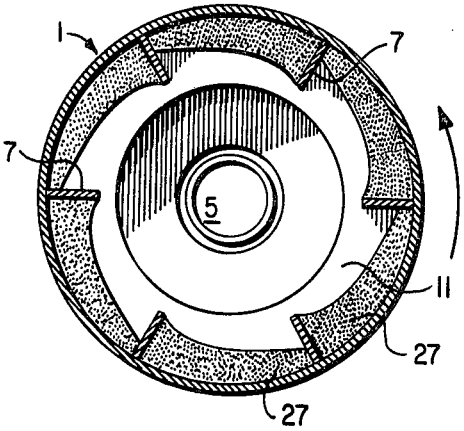
FIG. 3 is a diagrammatic view of FIG. 2 showing the accumulation of a gravel bed.

The rotating concentrator 1 of FIG. 1, is essentially an elongate cylindrical barrel. The barrel 3 has a front end baffle 21 and a back end baffle 23 at the other end of the device. The front end baffle has a feed pipe 5 mounted in bearings (not shown) that are situated in the center of the front end baffle 21. There is a discharge port 13 located centrally in the back end baffle 23. This discharge port 13 has a splash guard 25 located radially along the periphery of the discharge port 13. This splash guard 25 protrudes into the interior of the barrel 3.

The interior of the rotating concentrator 1 contains a number of essentially parallel longitudinal riffles 7, each one being attached throughout its length to the interior wall of the cylindrical barrel 3. A number of annular riffles 11 are disposed at right angles to the longitudinal riffles 7. These annular riffles 11 are attached, along their complete circumference, to the inner wall 9 of the cylindrical barrel 3. The annular riffles protrude a greater distance into the center of the barrel's interior than do the longitudinal riffles 7. The rotating concentrator 1 rests on two or more sets of idler casters 15 or other suitable bearings or it can rest on suitable drive units. The idler casters 15 are supported by brackets 17, which in turn rest on a supporting frame 19. The supporting frame 19 is adapted to be raised by suitable raising means at the infeed end of the rotating concentrator 1. A hydraulic jack may be used for such a purpose. Raising the infeed end of the frame 19 is done in order to tilt the rotating concentrator 1 along its longitudinal axis. This enables the removal of the concentrates that are collected in the device. The rotating concentrator 1 is revolved along its longitudinal axis by a suitable, variable speed, drive means. When the operator wishes to remove the contents of the rotating concentrator, he stops the inflow of slurry. The operator tilts the device, lowers its rpm and substitutes water for the slurry, at the inflow. The rpm falls below critical and the material adhering to the concentrator wall falls off and is washed out of the rotating concentrator.

DESCRIPTION OF THE PROCESS

The apparatus of the invention is capable of separating heavy minerals from materials of lesser specific gravity. The device of the invention has successfully separated gold, cassiterite and silver from placer gravel. Magnetic and non-magnetic black sands are also separated and this by-product may be sold in the future. The machine could also be employed to separate platinum, and scheelite from placer material. It is possible that the device might also extract ilmenite, zircon, rutile, and perhaps even columbite-tantalite particles. The use of the device of the invention is not even limited to handling placer material. It is conceivable that plant effluent and sewage may be treated for the recovery of metal particles.

Suitable placer material may be excavated from streams or dry placer deposits, spoils banks, or placer deposits covered by overburden. The excavation can be done utilizing the most modern methods of earth moving technology. The invention can handle these great tonnages of material and it is not hampered by water availability.

Mineral bearing material can be washed in a revolving scrubbing machine to separate particles from each other. The scrubbing also separates clay and other plastic material from the particulate matter. Scrubbing removes some of the oils and gums found in placer deposits.

After washing, the mixture of water and solid particles may be fed directly to the rotating concentrator 1 or it can be pre-screened. The washed material slurry is often screened to a convenient economic cut-off size of, for example, ½ inch or ⅜ inch. The larger material is cast off to tailings and not treated any further. Most of the gold series minerals (gold, platinum and silver) reside in the smaller particles. Although a minor amount of the estimated gold content of the deposit may be lost with the initial waste tailings, this loss is an economically justifiable trade-off since about 75% of the total placer material is removed from further processing. The cost of the screening is minor and the processing of large placer rocks would require pre-crushing, before concentration. Over-sized rocks could be subjected to a search with a metal detector of the discriminating heat frequency oscillator type in order to recover the odd mineral bearing particles. The washed slurry is then placed in the rotating concentrator, shown in FIGS. 1, 2, 3, 4 and 5. In one embodiment of the invention, material can be introduced into the device through feed pipe 5.

Figure 9:
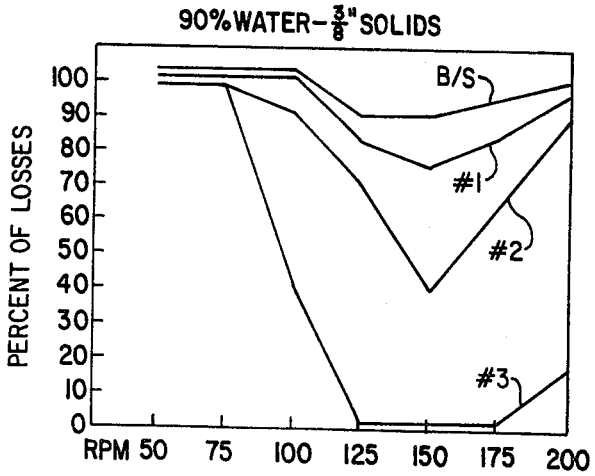
FIG. 9 is graph illustration of the rate of recovery of material of a 90% water feed slurry as a function of rpm.

The ratio of water to particulate matter should be roughly 50% to 75% as is shown in FIGS. 6, 7, 8 and 9 where a 7 foot 6 inch concentrator was used. A 50% water-particle ratio is particularly effective and any percentage of water over 75% causes significant loss of particles under 10 mesh Tyler as is shown in FIG. 9.

A 7 foot 6 inch long rotating concentrator of 20 inch diameter may be revolved at 125 to 175 revolutions per minute with 135–150 rpm being particularly effective. A 5 foot long rotating concentrator of 16 inch diameter worked particularly effective at 140–170 rpm.

The slurry falls through pipe 5, or other suitable carrying means, into the rotating concentrator 1. When the rotating concentrator is first started the slurry falls to the inner surface of the rotating concentrator 1 and it is lifted up by the rising longitudinal riffles 7 and the slurry is thus accelerated circumferentially. The water portion of the slurry and particles of light specific gravity falls back over the rising longitudinal riffles. The particles of heavier specific gravity in the slurry fall to the inner wall of the barrel 3. If the annular velocity of the particles, due to centrifugal force, is greater than the weight of the material, it will be held on the wall 3 as it revolves. The space between the longitudinal riffles 7 fills up with solid particles and the water then flows out of the compartment as barrel 3 rotates. The down flowing slurry shears over the longitudinal riffles, and in so doing forms a vortex in the area between adjacent longitudinal riffles 7. This vortex keeps particles of low specific gravity in suspension and they are ultimately carried along through a succession of annular compartments 29, 31, 33, and 35 and out of the rotating concentrator. The relationship between the placement size and number of both longitudinal riffles 7 and annular riffles 11 can effect the rate of recovery of mineral particles. These above noted factors plus the rpm can combine to create a maximum degree of vortex action. Good vortex and shearing action will maintain the suspension of light particles in water and effect efficient separation of the heavy component in the slurry.

Figure 4:
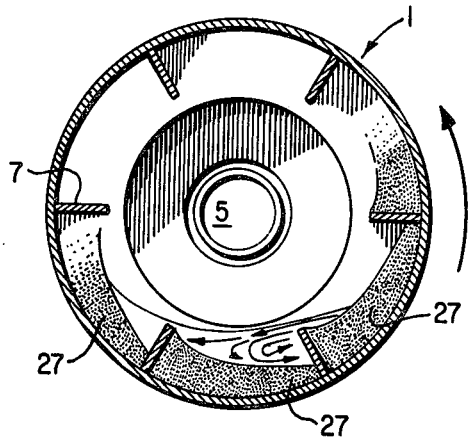
FIG. 4 is a diagrammatic view of FIG. 2 showing the gravel bed and vortex action of water.
Figure 5:
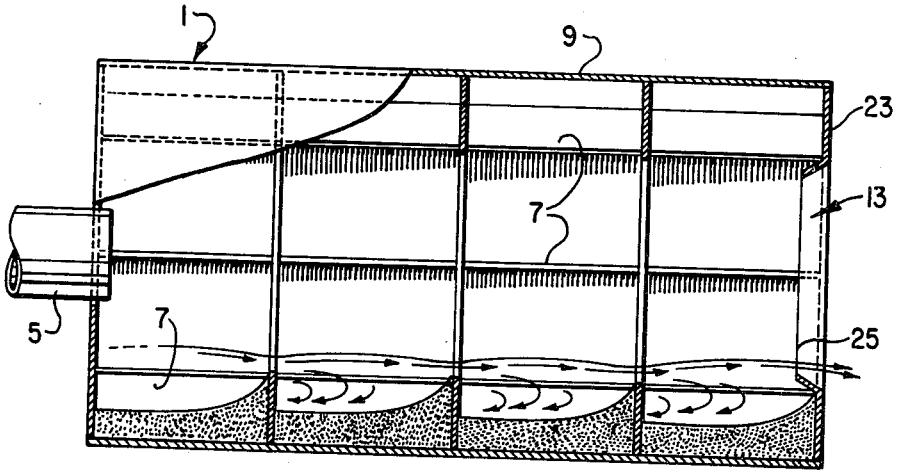
FIG. 5 is a longitudinal side diagrammatic section of the rotating concentrator showing the longitudinal flow of water and the riffling action of the annular riffles.
Figure 6:
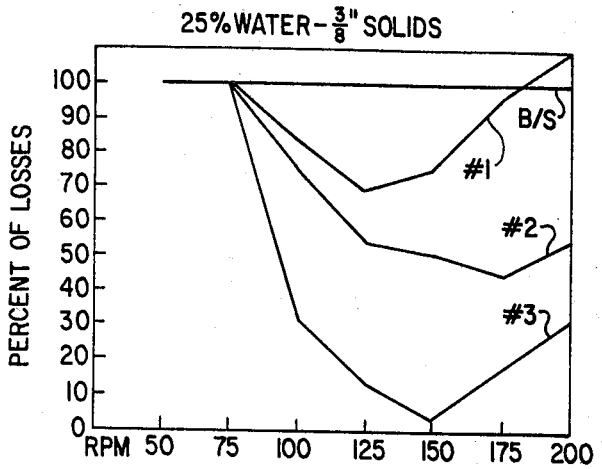
FIG. 6 is a graphic illustration of the rate of recovery of material of a 25% water feed slurry as a function of rpm.
Figure 7:
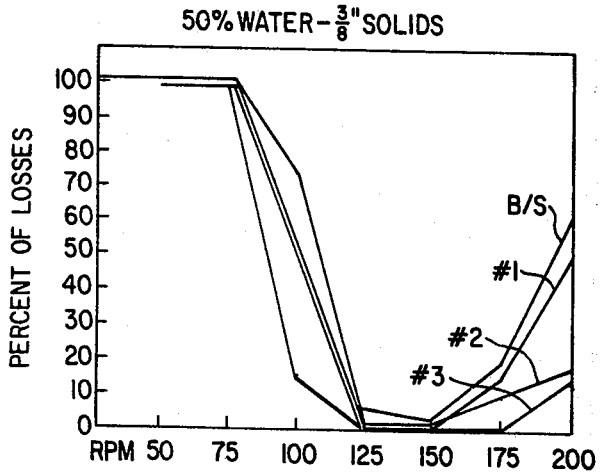
FIG. 7 is a graph illustration of the rate of recovery of material of a 50% water feed slurry as a function of rpm.
Figure 8:
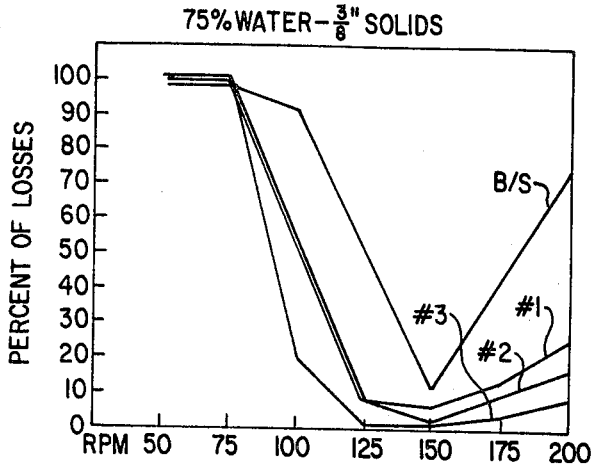
FIG. 8 is a graph illustration of the rate of recovery of material of a 75% water feed slurry as a function of rpm.

The adhering heavy particles 27 may be regarded as a stream bed. The first annular compartments 29 between the front end baffle 21 and the first annular riffle 30 is filled with adhering particles. Then the adjacent annular compartments 31 are filled until all the annular compartments 29, 31, 33 and 35 are filled successively. This stream bed 27 of FIG. 4 provides for the best tangential flow pattern for the slurry and it forms a bed which has a similar function as the canvas or felt used in the traditional sluice box. The bed of collected heavy material 27 helps to catch and hold heavy particles in its matrix.

After this stream bed is built up, very heavy particles in the slurry settle out and can displace less dense particles in the stream bed. The displaced particles can reenter the vortex and be swept out of the concentrator. In a regular sluice box, heavy gold particles can be denied displacement due to packed up riffles and the gold can be washed out.

This holding matrix phenomenon is important for soft, heavy placer minerals such as gold. Gold is the most ductile of metals and it tends to stretch, flatten, and bend more readily than it tends to break up into small particle size. This results in gold particles having high surface to weight ratios, and a pronounced tendency to be buoyant. Minute gold particles are easily swept away to the tailings in the turbulent waters of standard placer separation devices that use gravity. In the device of the invention, these particles, unaffected by the vortex action, settle to the concentrator barrel wall 3, and they are trapped in the matrix of adhering gravel 27, and thus protected from the scouring force of the slurry and held against and settle into the matrix by the centrifugal force applied by the rotating concentrator.

As soon as the slurry enters the rotating concentrator 1 all particles of aggregate suspended in it begin to settle out in accordance with Stokes Law. The settling rate for the more dense heavy elements is faster than that for the main body of the aggregate.

As the tank rotates the slurry flows continuously over the longitudinal riffles. At each riffle heavy elements are captured while sufficient vortex action is generated on the downstream side of the riffles to maintain the less dense aggregate in suspension.

The boundary layer of slurry along the stream bed 27 will be accelerated very nearly to the tangential velocity at the stream bed surface. The centrifugal force on this layer and on the heavy elements that have settled into it will be greater than its weight. As a result it is carried around with the rotating bed 27. During this rotation the heavy elements in the layer are subject to a force equal to several times their weight. Their rate of settling increases proportionately and they settle into the stream bed 27 where they are embedded and held by the radial centrifugal force.

During the time it takes the slurry to travel the length of the rotating concentrator 1 it flows over many circumferential meters of stream bed, the resulting action is the equivalent to idealized flow down an ordinary sluice box many meters long, but with the added advantage of centrifugal force for the retention of the heavy elements.

While the riffling action is taking place over the longitudinal riffles, the slurry is flowing longitudinally down the rotating concentrator 1. This latter flow takes place over the annular riffles. The riffling action here is required to prevent a smooth flow which would simply wash the stream bed 27 away along with the collected heavy element. For this reason the annular riffles must be somewhat higher than the longitudinal riffles. This results in a riffle action which establishes its own stream bed on the tangential stream beds, collects additional heavy elements and provides a vortex action which also keeps the main aggregate particles in suspension.

The steady rate of slurry inflow is generally maintained so as to equal the amount of outflow. This inflow rate maintains a sufficient steady lead in the interior of the rotating concentrator for effective separation. The inflow rate can be raised to just below that rate which begins to allow mineral lines to show up in the tailings.

As the concentrator is processing material, samples are regularly taken from the outflow and these are tested for the presence of mineral fines. When these fines are detected, the slurry inflow is stopped and water inflow substituted for slurry inflow. The rpm is simultaneously reduced to a rate less than critical and the rotating concentrator 1 is tilted up at the inflow end by raising means. Plain water is then introduced to wash out the contents of the rotating concentrator 1. Under these conditions the stream bed 27 and attended mineral particles fall off the walls and are washed out of the rotating concentrator 1 and they are collected for further treatment in a suitable apparatus. In the case of gold, platinum and silver, they can be passed through a nugget trap where large metal pieces are removed after a visual inspection and the fine material is put into an amalgamator or cyanide treatment apparatus to remove the metal. A centrifugal amalgamator has been found to be particularly useful for the purpose of extracting mineral fines. This device takes up little space and fits into a trailer unit which may house the concentrator and screens.

The action, dimension and placement of the annular and longitudinal riffles can affect the working efficiency of the invention.

Figure 10:
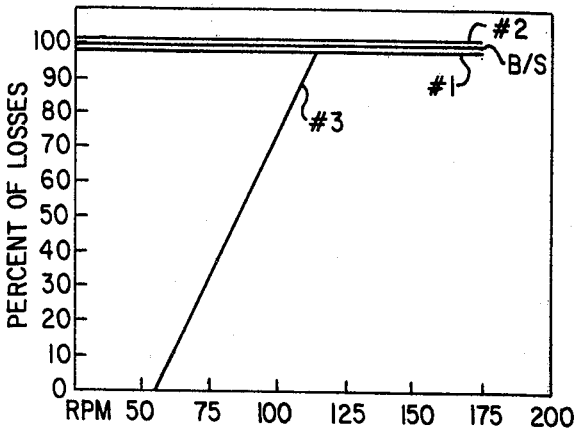
FIG. 10 is a graph illustration of the rate of recovery of the rotating concentrator, having only annular riffles, as a function of rpm.

A trial run was made with a 7 foot 6 inch rotating concentrator which lacked longitudinal riffles. The feed rate was kept constant at 11 pounds per second. Gravel, with measured amounts of added gold particles of assorted sizes, was added to the machine at a 50% water to gravel ratio. Percentage recovery was measured and is shown in FIG. 10. There was approximately 95% loss of all gold and black sand particle sizes under #10 mesh Tyler up to 55 rpm and recovery was 100% for gold particle sizes +10 mesh Tyler minus $\frac{3}{8}$ inches and losses grew drastically as the rpm was further increased. It was found that the concentrator very quickly packed up with solids and became blocked, when it was run at 150 rpm. The build up of solids at the infeed end of the device served to increase the velocity of water and it carried a greater load of gravel than usual out of the device.

Figure 11:
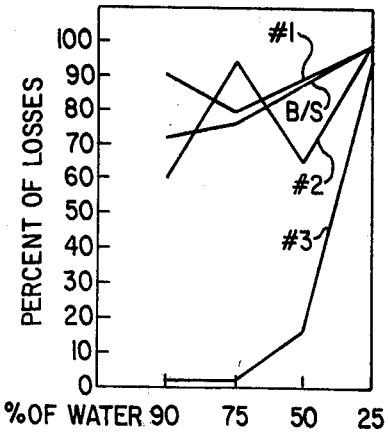
FIG. 11 is a graph illustration of the rate of recovery of the rotating concentrator, having only longitudinal riffles, as a function of the percentage of water in the feed slurry.

The annular riffles were removed from a 7-foot 6-inch concentrator and trial runs were undertaken with only the longitudinal riffles installed. Gravel, water and added gold of assorted sizes was processed. The rotational speed was kept constant at 150 rpm and the feed rate was 11 pounds per second. As is shown in FIG. 11, there was a large percentage of loss of gold particles under 10 mesh Tyler and also black sand. The loss occurred at all dilutions of gravel with water. Gold particles from 10 mesh Tyler to $\frac{3}{8}$ inch were recovered with small loss when the water to gravel ratio exceeded 50%. When there was less than 50% water, the losses of larger gold particles grew exponentially as the percentage of water decreased. It was noted that losses of gold particles to tailings grew with the amount of time elapsed. The machine plugged up and ceased working effectively when the water to solid ratio of the slurry was less than 50%. It was noted that when the concentrator lacked annular riffles, material settled out in the barrel and the longitudinal riffles were soon "drowned" under the accumulated solids. This "drowning" severely shortened the effective area of riffling action above the stream bed. The water tended to scour the stream bed and this action may account in part for loss of fine mineral particles.

Figure 12:
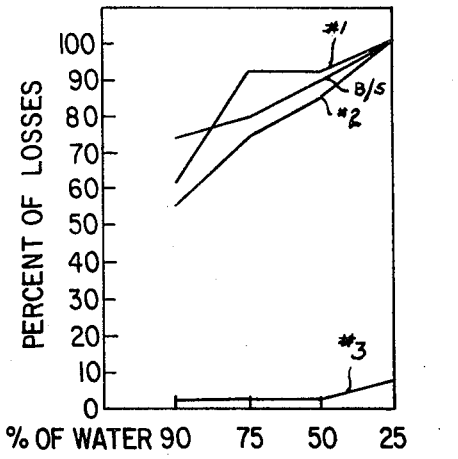
FIG. 12 is a graph illustration of the rate of recovery of the rotating concentrator having annular riffles of the same height as longitudinal riffles, as a function of the percentage of water in the feed slurry.

Tests were made with the 7 foot 6 inch concentrator having annular riffles and horizontal riffles of the same height and the results are shown in FIG. 12. A slurry with added gold particles of assorted sizes was processed in the concentrator. The concentrator was run at 150 rpm and the percentage of water to solids was changed for different tests. The feed rate was kept constant at 11 pounds per second. There were serious losses of gold particles under 10 mesh Tyler which increased as the percentage of water in the slurry decreased. Losses also increased directly with amount of time of the run. Black sand also was lost. Particles over 10 mesh Tyler were collected with not much loss, except for those particles which were flat pieces. At high dilutions of slurry (75% water or greater), longitudinal riffles tended to become "drowned" about 6 inches downstream beyond the annular riffle, which may account in part for some of the losses of fine gold particles.

Figure 13:
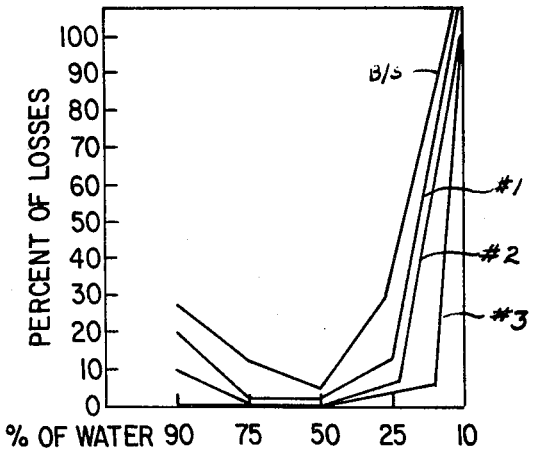
FIG. 13 is a graph illustration of the rate of recovery of a preferred embodiment of the rotating concentrator having annular riffles ¼ inch higher than longitudinal riffles, as a function of the percentage of water in the feed slurry.

This test shows that the device should have annular riffles higher than longitudinal riffles. FIG. 13 shows a preferred embodiment of the invention, with annular riffles $\frac{1}{4}$ inch higher than the longitudinal riffles. The 20 inch diameter rotating concentrator, of 7 foot 6 inch length, functions well at water dilutions, of about 30% to 75%. A 50% water to 50% particulate matter mixture is optimal. Material was fed in at a rate of 11 pounds per second and the device was run at 150 rpm. High water to particulate material ratios such as 90% create vortex disturbances with consequent losses of fine metallic particles.

The relationship between the various dimensions of the rotating concentrator is important. Process parameters, such as rpm, feed rate and slurry dilution, can affect the rate of mineral recovery. With a resonably good balance of parameters, the rotating concentrator produces effective interacting vortices set up by both sets of riffles. These vortices allow for the settling out of desired heavy minerals from the slurry, into the stream bed. The vortices should be sufficiently vigorous to suspend Strokes Law for lighter waste material and thus allow them to be carried away in the stream. The interval distances between all the riffles can influence the rate of recovery as they can help to sustain the vortices, and avoid both destructive interference and dead spots in the device.

The following factors can be modified to improve the working of the concentrator and a change in each factor may affect all of the others. The factors are, number, spacing and height of both the annular riffles and longitudinal riffles, and the diameter and length of the rotating concentrator, inflow rate of slurry, percentage of water to particulate matter in the slurry, and the revolution speed of the rotating concentrator. These factors will differ when a new length and diameter of concentrator is used. The most effective internal layout and operating parameters were empirically worked out. Whatever the exact layout of the rotating concentrator's interior details are, the device should have both longitudinal and annular riffles and the annular riffles should be higher than the longitudinal riffles. If the internal layout of both types of riffles is not considered the best, the revolution speed of the device can be changed to improve performance. RPM can often correct internal layout shortcomings.

A preferred embodiment of the invention is a rotating concentrator of cylinder length of about 7 feet 6 inches. The outside diameter of the barrel is about 20 inches. There are four annular riffles excluding the ends in the device with a riffle to riffle spacing of about 1 foot 6 inches from the centre of one riffle to the centre of the adjacent riffle. The width or thickness of each annular riffle is about ½ inch and the riffle has a height of about 2 inches. There are six longitudinal riffles in the rotating concentrator and they run along the length of the interior from substantially one end to the other. Adjacent longitudinal riffles are spaced about 10.5 inches apart at the peripheral wall. These riffles are about ½ inch thick and each has a height of about 1¾ inches. The preferred slurry ratio is 50% water to 50% solids, but other dilutions may be used. The optimal revolution speed is 128 rpm and this embodiment can process 20 tons of aggregate per hour.

An alternative embodiment of the device features a rotating concentrator about 16 inches in diameter and about 5 feet long. There are three annular riffles excluding the ends of the device and five longitudinal riffles. The three annular riffles have a riffle to riffle spacing of about 1 foot 3 inches from the centre of one riffle to the centre of the adjacent riffle. The annular riffles are 1⅜ inches high and the longitudinal riffles are 1⅛ inches high. The device works best with a slurry of 50% water to 50% particulate matter but other dilutions may be used and an rpm of 140–170 revolutions is considered optimal. The machines can process 8 tons of aggregates per hour.

The device of the invention can be made in different lengths and diameters and function equally as well as the two preferred embodiments disclosed.

It may be concluded that an effective rotating concentrator capable of extracting metallic fines from particulate material, should at least have both annular and longitudinal riffles and the annular riffles should be higher than the longitudinal riffles for the device to work well and have good levels of extraction of fine metallic particles. The additional parameters, mentioned before, may make some further improvements in the efficiency of recovery.

DESCRIPTION OF THE TRAILER UNIT

Figure 14:
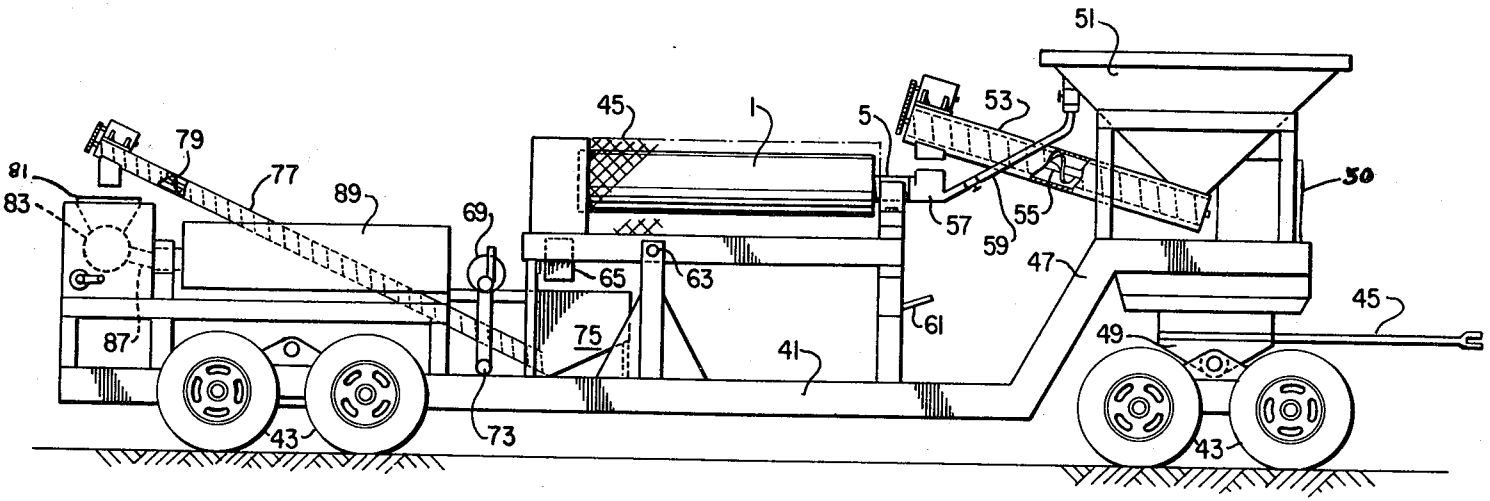
FIG. 14 is a side view diagrammatic illustration of the trailer housing the feed hopper, rotating concentrator, pumps, centrifugal amalgamator and connecting circuits of the process of the invention.
Figure 15:
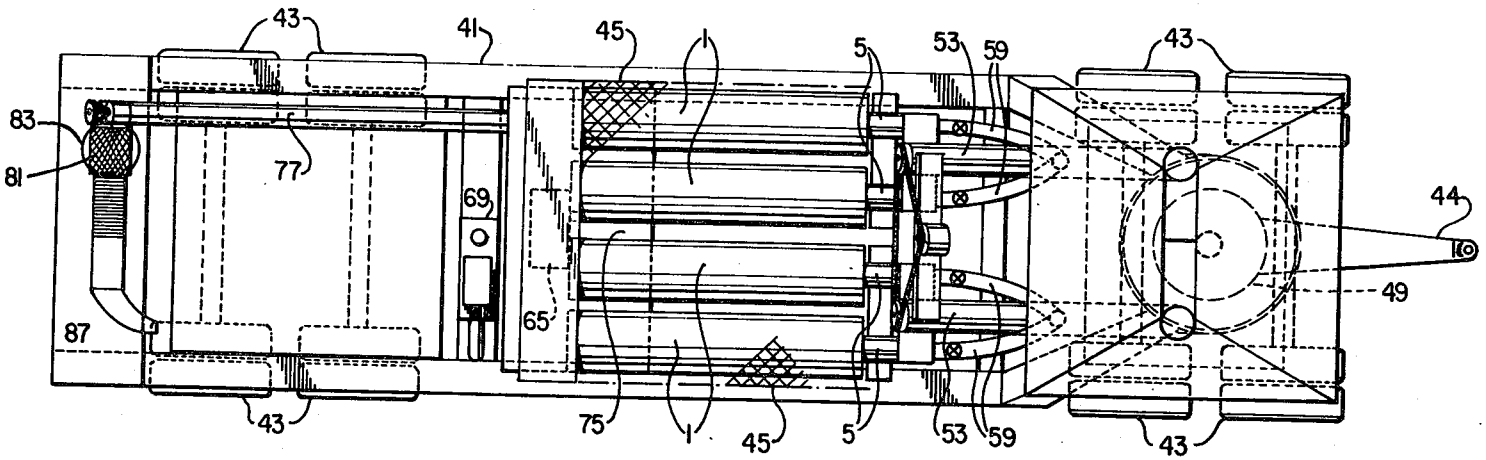
FIG. 15 is a plan view diagrammatic illustration of the trailer of FIG. 14 showing the process of the invention.

The device of the invention can be housed in a completely mobile trailer unit which can be transported to the area to be worked. Such a trailer has been moved 1300 miles over paved and gravel roads, in three days, with no problems. One trailer unit contains the rotating concentrator, concentrate bin, centrifugal amalgamator and electrical switching gear. This trailer is shown in FIGS. 14 and 15. Another trailer houses a grizzly, hopper and conveyor.

This first trailer will be described herein.

In a preferred embodiment of invention shown in FIGS. 14 and 15, the trailer 41 of the invention is shown. The trailer has a plurality of wheels 43, and a draw bar 44 for towing. The front end of the trailer 41 has a goose-neck 47 with an optional removable bogey 49. Above the goose neck is an electrical generator 50.

The material to be concentrated is placed in the feed hopper 51 and the material is then raised through 2 tubes 53 of FIG. 14 by lifting means such as an Archimedes screw 55 (also called an auger feed). In an alternative embodiment of the invention, the feed hopper is adapted to be raised higher than the rest of the trailer by raising means. This alternative embodiment obviates the need for lifting means, such as tubes 53, to the concentrator 1. The material in FIG. 14 is dumped into several pipes 57 which are connected to feed pipes 5. Other pipes 59 also connect into feed pipes 5. These pipes 59 supply additional water to make up the desired percentage slurry of water and particulate material. The trailer unit has suitable pipe means to hook up to a source of water. The feed pipes 5 feed into a plurality of rotating concentrators (four being shown in FIG. 15). One feed pipe 5 fits into each concentrator. The concentrators 1 can be housed in a protective wire box 45 or left open.

The number of rotating concentrators used is optional. FIG. 15 shows a trailer unit with 4 rotating concentrators. Such an embodiment has 2 motors to power the 4 devices. It is conceivable that more machines could be placed in the trailer unit as they take up little space. In one embodiment of the invention, the rotating concentrator is only 20 inches in diameter and 7½ feet long.

The feed rate of slurry is kept at that rate of inflow equal to the rate of outflow and can be increased up to almost the rate where mineral particles start to show up in the tailings. There is about 20 tons per hour of material processed in each 20 inch barrel. One man can handle probably the whole inflow portion of the operation.

Each concentrator can be tilted individually by using a hydraulic means 61 together with a pivot linkage 63. Tilting is done to help empty the concentrates from the concentrators 1 by stopping inflow and washing out with water while the device rotates. A tilt angle of about 3° is sufficient for this purpose. The tailings flow out of the rotating concentrator through the hole in the back end baffle 23. The tailings then flow out through the tailings chute 65. A tailings pump 69 can be used to pump the gangue out to the pump discharge 73 and the tailings are disposed of in a suitable manner. Where the process material is placer gravel, the tailings are placed in the previous placer gravel excavation. These tailings are layered on top of the previously discarded oversized material that was rejected at the first screening. Classified and stratified tailings are more readily and quickly colonized by plants. This environmental factor is a benefit of the process of the invention. The more dilute tailings of the standard sluice box causes silting, and these tailings are not readily colonized by plant matter.

The concentrated material is removed from the rotating concentrators and placed in a concentrates box 75 of FIG. 15. The concentrates may then be moved through a concentrate pipe 77 with an Archimedes screw lifting device 79 or other suitable lifting means. If gold, silver, or platinum is being extracted, the concentrates can be passed through a nugget trap 81 and then delivered to a centrifugal amalgamator 83, or sent directly to the centrifugal amalgamator 83 without going through the nugget trap. The nugget trap 81 is a screen which holds back large particles which are not particularly suitable for amalgamation. The material is passed down into the centrifugal amalgamtor 83 and the gangue passes up and out of the device. The mercury is collected and gold, silver and platinum is extracted by standard means such as retorting. The gangue is passed through a tail race 87 and is disposed of in the previously excavated hole in the ground. Alternatively the gangue can be put through a mercury salvage reconcentrator located near the amalgamator. If the mineral to be extracted is not gold, silver or platinum, alternative equipment will be used after the rotating concentrator is stripped of mineral particles. Such machinery may be installable in the trailer unit, if there is room.

The apparatus and process of the invention has been tested in field trials in several locations in Western Canada.

EXAMPLE 1

A trailer containing the 7 foot 6 inch concentrator invention was taken into an area near Quesnel, British Columbia, 400 highway miles from Vancouver. The device was tested on new, uprocessed placer deposits. The unit worked alongside a traditional unit employing a trommel and shaking tables. The two processes were alternately fed from the same excavation by a power shovel. The workings proved to be lean and no colours in fine gold were observed on the tables and no table recovery of gold was obtained. The device of the invention processed the same feed and yielded $1.47 cubic yard gold values computed at the value of $160.00 per fine ounce. The gold was finely divided flour gold, no gold was observed in the device's tailings.

EXAMPLE 2

A section of ground along the Similkameen River near Princeton, British Columbia was worked. This material processed was old placer tailings. The average value or recovered gold was $2.27 per cubic yard of feed calculated at $180 per fine ounce. Roughly 95% of the gold was in fine particles. 66% of the gold was retained on 20 to 30 mesh screen and approximately 5% remained as particles suspended in amalgam. Independent laboratory analysis indicated that suspended material to be as small as 2.5 microns.

EXAMPLE 3

The device of the invention was tested at a commercial gravel pit, having no known gold, near Langley, British Columbia. Pit run gravel showing no colours in gold and very minor black sand on panning was used as feed. The device of the invention yielded very fine gold with negligible losses. The value of the gold extracted was about $1.40 per cubic yard calculated at a value of $250 per fine ounce.

EXAMPLE 4

The device has been tested on ground containing scheelite ore (a tungsten compound) and the device of the invention made a very effective separation of scheelite.

While the invention has been described and illustrated with respect to a preferred embodiment, it will be understood by those skilled in the art that various changes and modifications may be made without departing from the spirit and scope of the invention and it is intended therefore in the appended claims to cover all such changes and modifications.

The embodiments of the invention in which an exclusive property or privilege is claimed are defined as follows:

1. Apparatus for extracting heavy metal from a precious metal-bearing ore comprising:

a rotatably mounted cylindrical drum having a substantially horizontally disposed axis, said drum having an input end, an output end, and an internal peripheral surface, said input end being substantially closed about input pipe means adapted for flowing a slurry of precious metal ore into said drum at a predetermined rate, the internal peripheral surface of said drum having a plurality of continuously annular riffles of predetermined height evenly spaced from the closed input end to and including the output end and having a plurality of longitudinally extending circumferentially spaced riffles of a height less than said annular riffles, means for selectively rotating said drum at a predetermined speed, the size, spacing and respective heights of the longitudinal riffles and annular riffles, and the speed of the rotation of the drum are each such that the slurry is caused to vortex in a helical fashion over the said riffles and build a stream bed-like matrix of heavier particles within compartments formed by the riffles, the speed of rotation of the drum such that the matrix is maintained within the compartment by centrifugal force with the vortex action causing heavier particles to settle and form part of the matrix within the compartments, while the lighter particles are kept in suspension by the vortex action and are carried out of the apparatus through the output end, means for selectively and periodically tilting said drum and flushing out said matrix with liquid.

2. Apparatus according to claim 1 wherein said drum is about 7½ feet long and has an outside diameter of about 20 inches, said drum having four annular riffles spaced internally between said ends and approximately 2 inches in height and having 6 longitudinal riffles between said ends and about 1¾ inches in height, said means for rotating said drum adapted to rotate said drum at from about 100 to 150 rpm and means for introducing said slurry at about 30 to 75 percent ratio of water to particulate metal bearing ore.

3. An apparatus according to claim 1 having the drum rotated at a speed of at least 100 revolutions per minute.

4. An apparatus according to claim 1 having the drum rotated at a speed of at least 120 revolutions per minute.

5. An apparatus according to claim 1, 3 or 4 having an input slurry comprised of 50 to 75% water.

6. An apparatus according to claim 1, 3 or 4 having an input slurry of 50% water.

7. Apparatus according to claim 1 wherein said drum is about 5 feet in length and has an internal diameter of about 16 inches, said drum having three evenly spaced annular riffles between said input and output ends, each about 1⅜ inches in height and 5 longitudinal riffles, each about 1⅛ inches, said means for rotating said drum adapted to rotate said drum at from about 140–170 rpm and means for introducing said slurry at about 30 to 70 percent ratio of water to particulate metal bearing ore.

* * * * *